US007108571B2

(12) United States Patent
Geraghty

(10) Patent No.: US 7,108,571 B2
(45) Date of Patent: Sep. 19, 2006

(54) METHOD AND APPARATUS FOR ATTACHING A FIN TO A SMALL WATERCRAFT

(76) Inventor: Dean Geraghty, 42 Pienaar Road, Milnerton (ZA) 7441

( * ) Notice: Subject to any disclaimer, the term of this patent is extended or adjusted under 35 U.S.C. 154(b) by 0 days.

(21) Appl. No.: 10/482,126

(22) PCT Filed: Jun. 28, 2002

(86) PCT No.: PCT/IB02/02498

§ 371 (c)(1),
(2), (4) Date: Jul. 19, 2004

(87) PCT Pub. No.: WO03/002405

PCT Pub. Date: Jan. 9, 2003

(65) Prior Publication Data

US 2004/0242093 A1 Dec. 2, 2004

(30) Foreign Application Priority Data

Jun. 29, 2001 (ZA) ..... 2001/5380

(51) Int. Cl.
*B63B 41/00* (2006.01)
*B63B 35/79* (2006.01)

(52) U.S. Cl. ..... 441/79; 114/39.15

(58) Field of Classification Search ..... 114/39.15, 114/127, 132, 140; 441/79
See application file for complete search history.

(56) References Cited

U.S. PATENT DOCUMENTS 3,564,632 A * 2/1971 Bahne, Jr. ..... 441/79
4,493,665 A 1/1985 Liddle
4,804,347 A 2/1989 Ross
4,811,674 A * 3/1989 Stewart ..... 441/79
4,854,904 A 8/1989 Wahl
5,464,359 A 11/1995 Whitty
5,493,989 A 2/1996 Anderson
5,649,846 A 7/1997 Harper et al.
5,975,974 A 11/1999 McCausland
6,053,789 A 4/2000 Miyashiro
6,139,383 A 10/2000 Jolly et al.
6,213,044 B1 * 4/2001 Rodgers et al. ..... 114/152
6,386,933 B1 5/2002 Johnston et al.

FOREIGN PATENT DOCUMENTS

DE 31 49 288 A1 * 8/1983
WO WO 9531366 11/1995
WO WO 99/21755 A1 5/1999

* cited by examiner

*Primary Examiner*—Sherman Basinger
(74) *Attorney, Agent, or Firm*—Millen, White, Zelano & Branigan, P.C.

(57) ABSTRACT

Apparatus is provided for attaching a fin to the underside of a small watercraft, such as a surfboard. The apparatus includes a holder which is attachable to the underside of the surfboard, so that a recess defined in the holder extends inwardly from the underside. The apparatus further includes a fin sub-assembly comprising a fin and a body which is receivable within the recess defined in the holder. The fin sub-assembly can be received in the holder in a plurality of angular orientations about an axis generally perpendicular to the underside of the surfboard. The invention extends to a holder, a small watercraft, and a method for attaching a fin to an underside of a small watercraft.

9 Claims, 5 Drawing Sheets

METHOD AND APPARATUS FOR ATTACHING A FIN TO A SMALL WATERCRAFT

FIELD OF THE INVENTION

THIS invention relates to small watercraft, such as surfboards and the like. In particular, it relates to a method and apparatus for attaching a fin to a small watercraft, and to a small watercraft.

BACKGROUND OF THE INVENTION

Fins are often provided on the undersides of small watercraft, such as surfboards, sailboards, waveski's, etc., to alter the fluid-dynamic properties of the watercraft, to limit lateral movement of the watercraft through water, to assist in directing the watercraft, etc.

Fins can be fixedly joined to the underside of the watercraft, but such fins significantly increase the overall dimensions of the watercraft and increase the space required when transporting the watercraft. These fins are also vulnerable to damage when the watercraft is handled, transported, or the like, and hold the further disadvantage that they are not adjustable to vary the fluid-dynamic properties which they impart on the watercraft.

Fins can be removably mounted to the underside of the watercraft, e.g. by removably mounting the fin in a box embedded within the watercraft, and retaining the fin in the box, e.g. by way of screws abutting a lower part of the fin. A fin can be mounted in a slot defined within the box, and the slot can have an elongate shape, allowing the fin to be adjusted longitudinally within the box, but other than this adjustment, this type of fin mounting does not make provision for changing the hydrodynamic properties of the watercraft, e.g. by adjusting the toe-in or the splay of the fin.

The "toe-in" of the fin is the orientation of a planar part of the fin in relation to a longitudinal axis of the watercraft, while the "splay" of the fin is the angular orientation of the planar part in relation to the undersurface of the watercraft.

SUMMARY OF THE INVENTION

According to a first aspect of the invention, there is provided, apparatus for attaching a fin to the underside of a small watercraft, said apparatus including:

a holder defining a recess, the holder being attachable to the watercraft, with the recess extending inwardly from the underside of the watercraft; and a fin sub-assembly including a body which is receivable within the recess defined in the holder, in a plurality of angular orientations about an axis generally perpendicular with the underside of the watercraft.

The fin sub-assembly may include a body defining a fin slot in which an attachment formation of the fin is releasably receivable, or the fin sub-assembly may include a fin with a base of the fin attached to the body.

The fin slot may have an elongate shape, such that an attachment formation of the fin is longitudinally displaceable, when received in the fin slot. The body may include fin locating means, disposed to locate an attachment formation of the fin relative to the body, when received in the fin slot. The fin locating means may include at least one fastener, which is displaceable to protrude into the fin slot by varying degrees, to abut the attachment formation of the fin, when received in the fin slot, e.g. by being displaceable between a free condition in which a gripping end of the fastener is set back from the fin slot, and a gripping condition in which the gripping end protrudes into the fin slot, to abut the attachment formation.

The recess defined in the holder may have cylindrical walls, and the body may have a complemental cylindrical periphery. The body may be arcuately displaceable about the axis, when received within the recess defined in the holder, to adjust the toe-in of the fin, and the apparatus may include body locating means, for locating the body relative to the holder.

The body locating means may be displaceable between:

a free condition in which the body can be removed from the recess;

an adjustment condition in which the body is held captive within the recess, but can move arcuately about the axis, relative to the holder; and a locating condition in which the body is located relative to the holder.

The body locating means may include at least one clip formation, or at least one fastener, connectable to the body and to the holder. Each fastener may be connectable to the body by extending through a screw slot defined in the body, and may be releasably connectable to the holder.

According to another aspect of the invention, there is provided a holder for attaching a fin to the underside of a small watercraft, said holder defining a cylindrical recess in which a body is receivable, and said holder including receiving formations, disposed to receive at least one fastener locating a body within the recess.

According to a further aspect of the invention, there is provided a small watercraft, which includes at least one holder as defined hereinabove, attached to the underside of the watercraft, wherein the recess extends inwardly from the underside of the watercraft, and the axis of the recess extends generally perpendicular to the underside of the watercraft.

According to yet a further aspect of the invention, there is provided a method of attaching a fin to an underside of a small watercraft, said method comprising the steps of:

providing a holder on the underside of the watercraft, said holder defining a recess extending inwardly from the underside;

receiving a body in the recess, the body forming part of a fin sub-assembly; and locating the body within the recess by way of body locating means.

The method may include the step of arcuately displacing the body about an axis generally perpendicular to the underside, prior to locating the body, and may include the further step of locating a fin relative to the body.

BRIEF DESCRIPTION OF THE DRAWINGS

The invention will now be described, by way of non-limiting example, with reference to the accompanying diagrammatic drawings.

In the drawings.

DETAIL DESCRIPTION OF DRAWINGS

Figure 1:
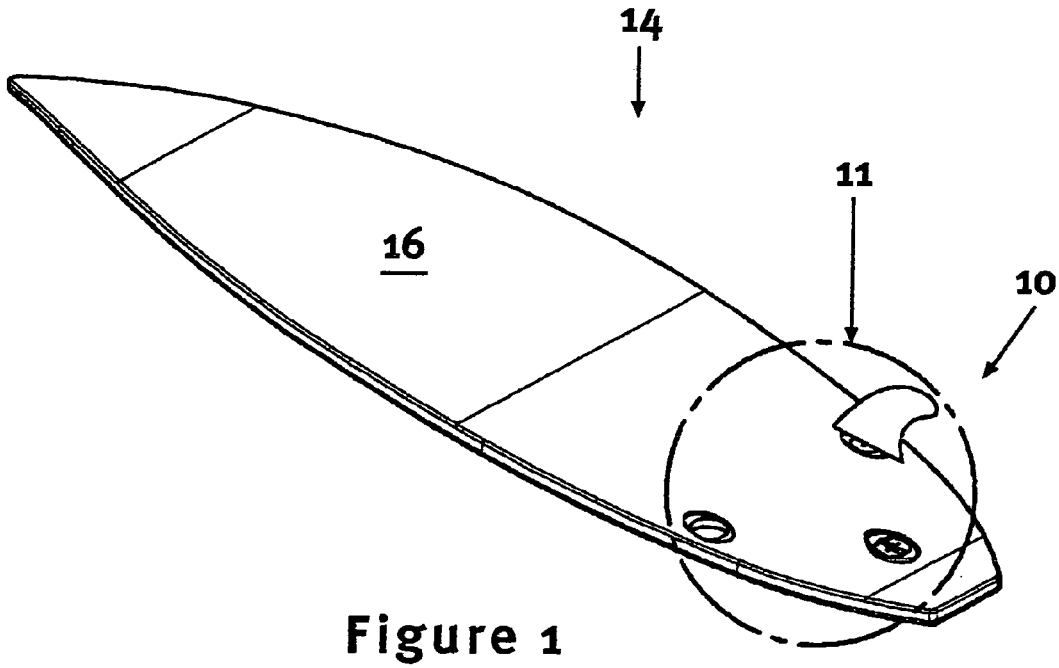
FIG. 1 shows a three-dimensional bottom view of a small watercraft in accordance with the invention.

Referring to the drawings, apparatus for attaching a fin to the underside of a small watercraft, in accordance with the invention, is generally indicated by reference numeral 10.

The apparatus 10 includes a holder 12 which is attachable to an underside of a small watercraft, in the form of a surfboard 14, by being embedded in the surfboard to be flush with an undersurface 16 of the surfboard, and includes a fin subassembly comprising a fin 18 and a body 20. The body 20 is receivable in a recess 22 defined in the holder 12.

Figure 2:
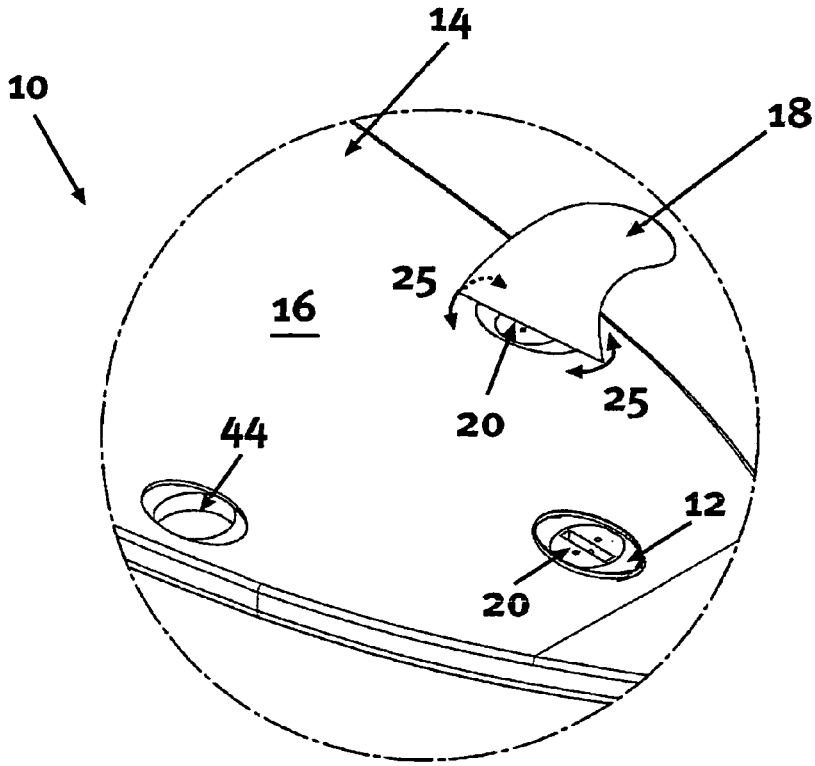
FIG. 2 shows a three-dimensional detail view of a rear part of the watercraft of FIG. 1.

The recess 22 has a cylindrical wall 24 and the body 20 is disc-shaped, with a cylindrical periphery which is complemental to the wall 24, so that the body can be moved arcuately about its axis, when received within the recess 22. The common axis 23 of the body 20 and cylindrical wall 24 is generally perpendicular to the undersurface 16 of the surfboard 14, so that arcuate movement of the body about the axis 23 allows it to have a plurality of angular orientations, and accordingly allowing the fin 18, when attached to the body 20, to have a plurality of angular orientations about the axis, and thus adjusting the toe-in of the fin as shown by the arrow indicated by reference numeral 25 in FIGS. 2 and 3 of the drawings.

The body 20 is attachable to the holder 12, when received in the recess 22, by body locating means in the form of two capped screws 26. Each screw 26 extends through a screw slot 28, defined in the body 20, and into an internally threaded aperture 30 defined in a shoulder formation 32 disposed in the recess 22. Each screw slot 28 is elongated in a circumferential direction, so that its associated screw 26 can slide along the screw slot.

In a free condition of the body locating means, the capped screws 26 are removed from the apertures 30, so that the body 20 can be removed from the recess 22. In an adjustment condition of the body locating means, the capped screws 26 extend through the screw slots 28 and are received in the apertures 30, but are not fastened, thereby holding the body 20 captive in the recess 22, but allowing the body to rotate about the axis 23 relative to the holder 12. In a locating condition of the body locating means, the capped screws 26 are fastened, to urge the body 20 into abutment with the shoulder formations 32, and thereby locating the body 20 relative to the holder 12.

Instead of fasteners, such as capped screws 26, the body 20 may be attached to the holder 12 by other suitable attachment means, such as clip formations (not shown).

An elongate fin slot 34 is defined in the body 20, in which an attachment formation 36 of the fin 18, is releasably receivable, and is longitudinally displaceable. The fin 18 is located relative to the body 20 by fin locating means in the form of two grub-screws 38, screw-threadedly received in diagonal screw passages 40, to abut the attachment formation 36. The grub-screws 38 are screw-threadedly displaceable within the passages 40, so that a gripping end of each grub-screw can protrude into the fin slot 34 by varying degrees. The grub-screws 38 are displaceable between a free position in which they are withdrawn entirely from the fin slot 34 and the attachment formation 36 can be removed from the fin slot, an adjustment condition in which they protrude into the fin passage and into lateral recesses 42 defined on the attachment formation 36, to hold the attachment formation captive within the fin slot, but allow longitudinal movement of the fin 18, and a locating condition in which the gripping ends of the grub screws abut the attachment formation, to locate the fin 18 relative to the body 20.

In another embodiment of the invention (not shown) the fin 18 is located relative to the body 20 by fin-locating means in the form of one or more fasteners, such as screws extending through a bottom wall of the body, disposed at a bottom of the fin slot 34, and extending into the fin.

Figure 5:
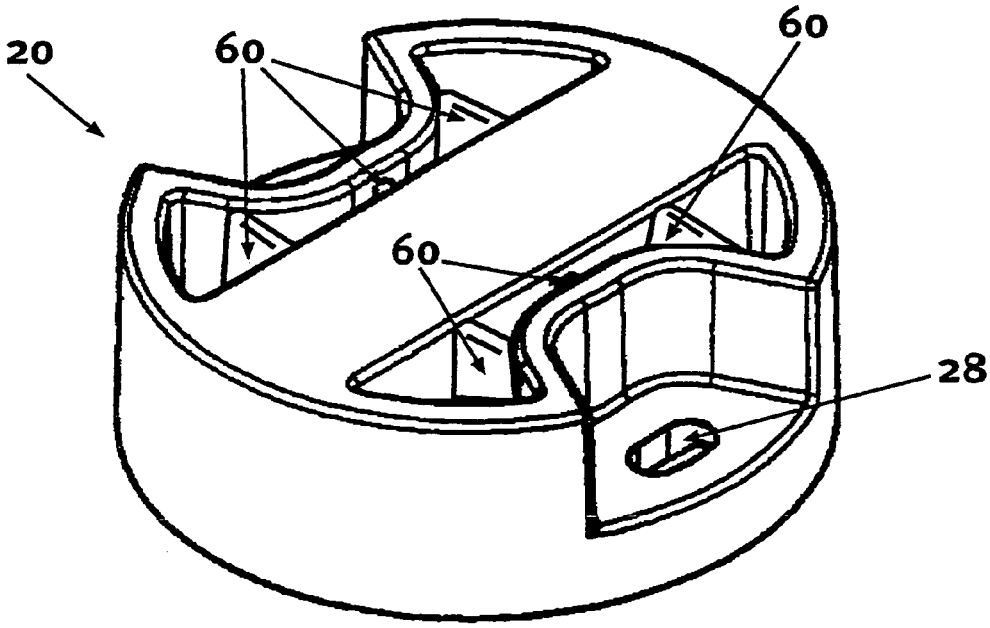
FIG. 5 shows a three-dimensional bottom view of the body of the apparatus of FIG. 3.

Referring to FIG. 5 of the drawings, webs 60 extend between walls of the fin slot 34, and peripheral walls of the body 20, to add structural strength.

A face 50 of the holder 12 is oval in shape, to protect the undersurface 16 of the surfboard 14 against damage by the fin 18.

In use, the holder 12 is attached to the surfboard 14 by embedding the holder into a recess 44, defined in the underside of the surfboard. The holder 12 is fixed within the recess 44 by way of adhesive, such as a resin. As can best be seen in FIG. 6 of the drawings, surface irregularities 46 are defined on outer surfaces of the holder 12, to increase the purchase area of adhesive to the outer surfaces. A peripheral lip 48 extends around the face 50 of the holder 12, to prevent liquid used in installing the holder, such as resin, from fouling the face. The lip 48 is later removed so that the face 50 is flush with the undersurface 16 of the surfboard 14.

Figure 3:
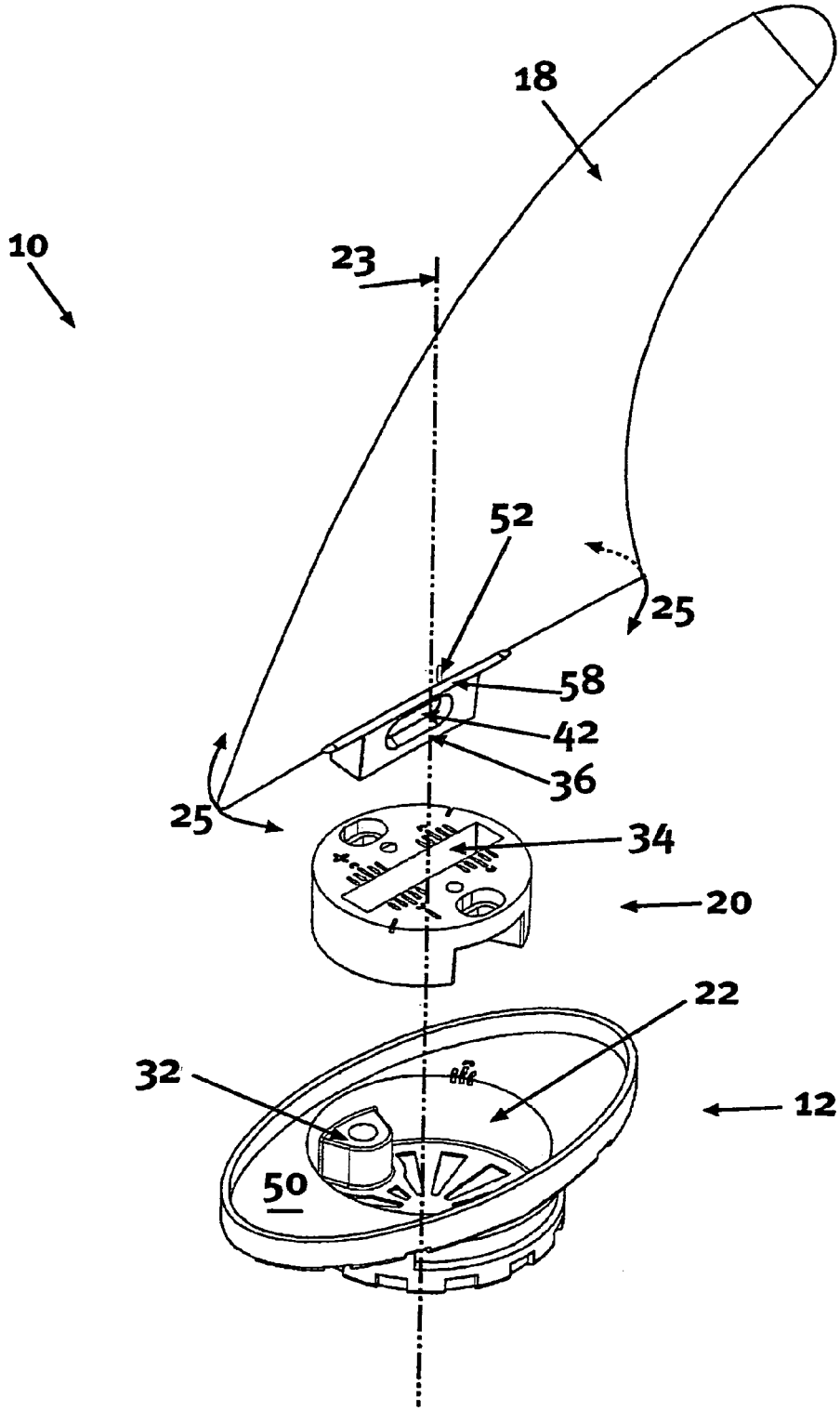
FIG. 3 shows an exploded three-dimensional view of a fin and apparatus for attaching the fin to an underside of a small watercraft, in accordance with the invention.
Figure 4:
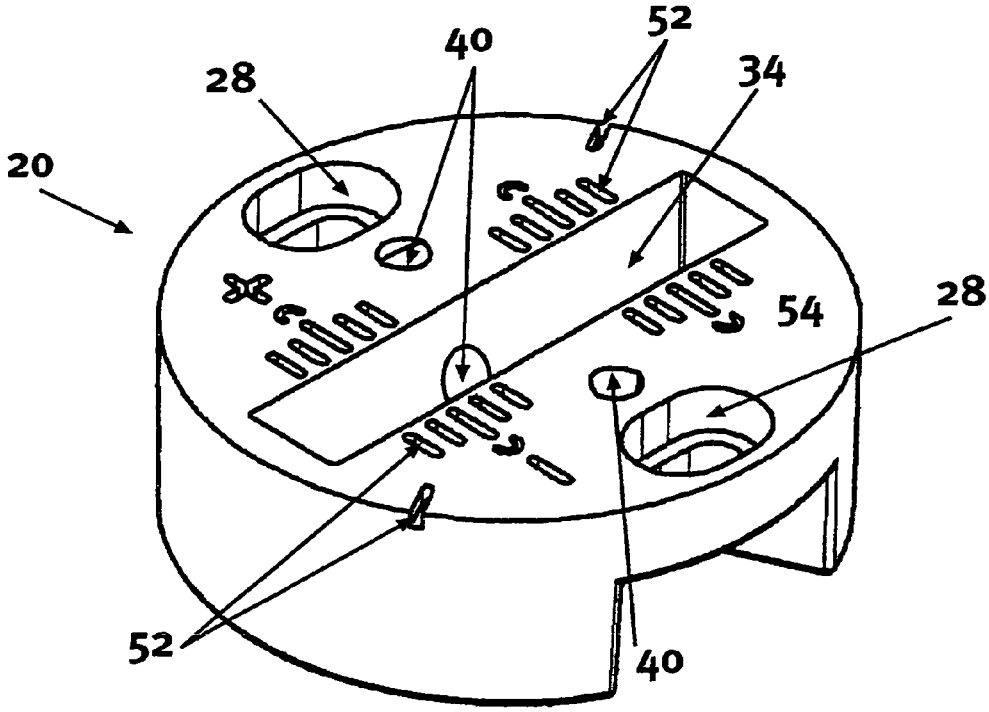
FIG. 4 shows a three-dimensional top view of a body of the apparatus of FIG. 3.
Figure 7:
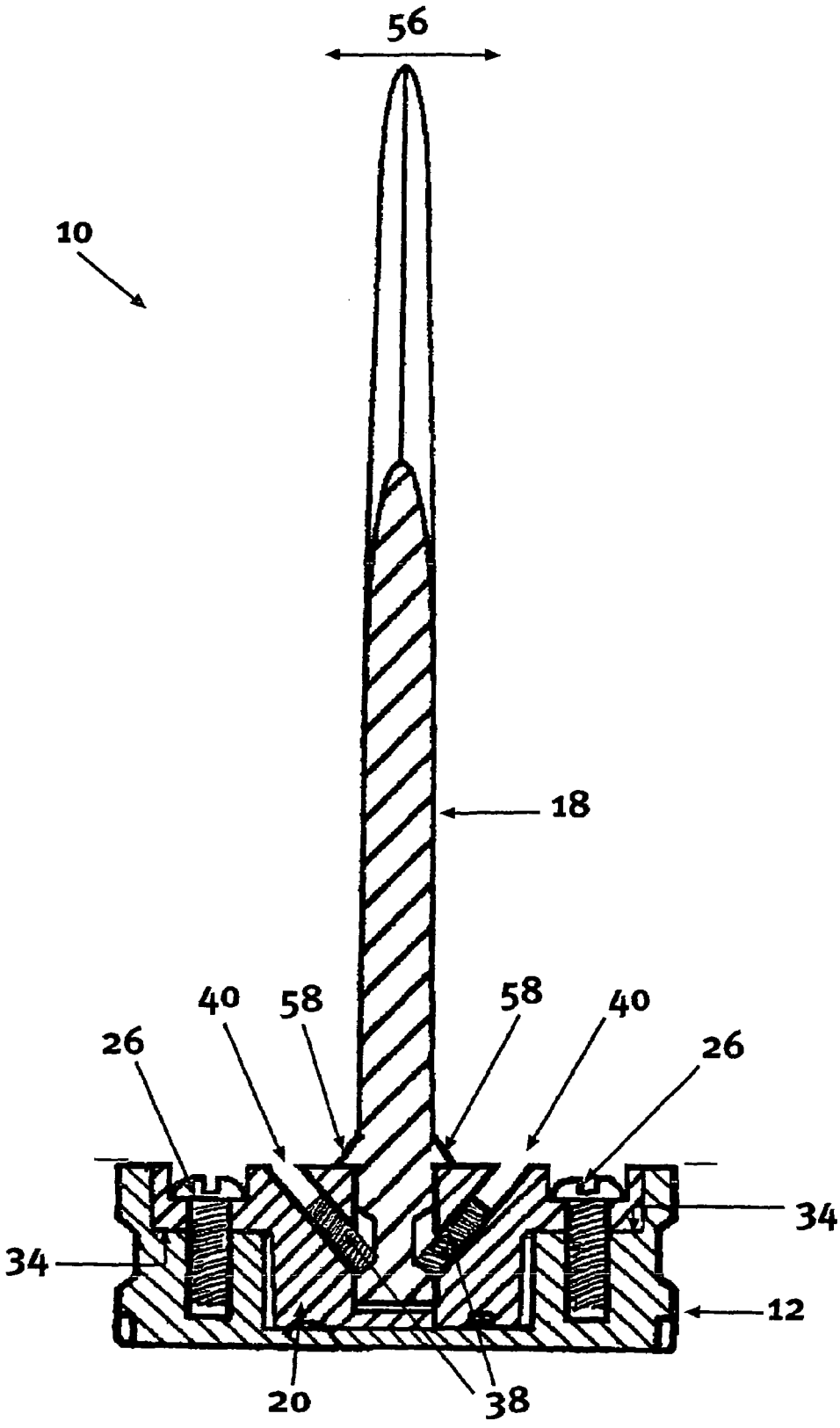
FIG. 7 shows a sectional front view of the fin and apparatus of FIG. 3.

Referring to FIGS. 3 and 7 of the drawings, the fin 18 is attached to the body 20, which in turn is attached to the holder 12, as described hereinabove. The fin 18 is longitudinally displaced within the fin slot 34, to a desired position. The toe-in of the fin 18 is adjusted by arcuate movement of the fin 18 and the body 20 about the axis 23, as described hereinabove.

The splay of the fin 18 is determined by the angular orientation of internal walls of the fin slot 34, relative to the body 20. If the splay of a fin needs to be altered in the direction of the arrows indicated by reference numeral 56 in FIG. 7 of the drawings, the body 20 may be replaced by a different body 20, in which the internal walls of the fin slot have a different orientation.

Indicating grooves 52 are formed on the face 50 of the holder 12, a face 54 of the body 20, and laterally on the fin 18, near its base. The indicating grooves 52 give an indication of the longitudinal movement of the fin 18 relative to the body 20, and of the arcuate movement of the body 20 relative to the holder 12.

The fin 18, body 20, and holder 12 are made of a strong, durable, corrosion resistant material, such as a hard plastics material, or a composite material.

Covers (not shown) can be used to close off the openings of the screw slots 28 and screw passages 40, to be flush with the face 54 of the body 20, to reduce flow resistance when water flows across the face 54, when the surfboard 14 is used.

In an embodiment not shown in the drawings, the holder 12 may be configured to extend from the undersurface 16, through the surfboard 14 to the vicinity of a deck (not shown) of the surfboard, so that the holder is fixedly attached to the underside and the deck of the surfboard, thus providing structural strength. Instead, an annular groove, or like incision, may be made extending from the recess 44 to an underside of the surfboard deck. The recess may be filled with resin, which forms a structural element extending between the surfboard deck and the holder 12, when the resin has cured.

A ridge formation 58 is formed on each side of the fin 18 at its base. The ridge formation 58 abuts the face 54 of the body 20 and/or the face 50, when the fin 18 is attached to the body, thereby adding stability of the fin against deflection in the direction shown by reference numeral 56 in FIG. 7 of the drawings.

Figure 6:
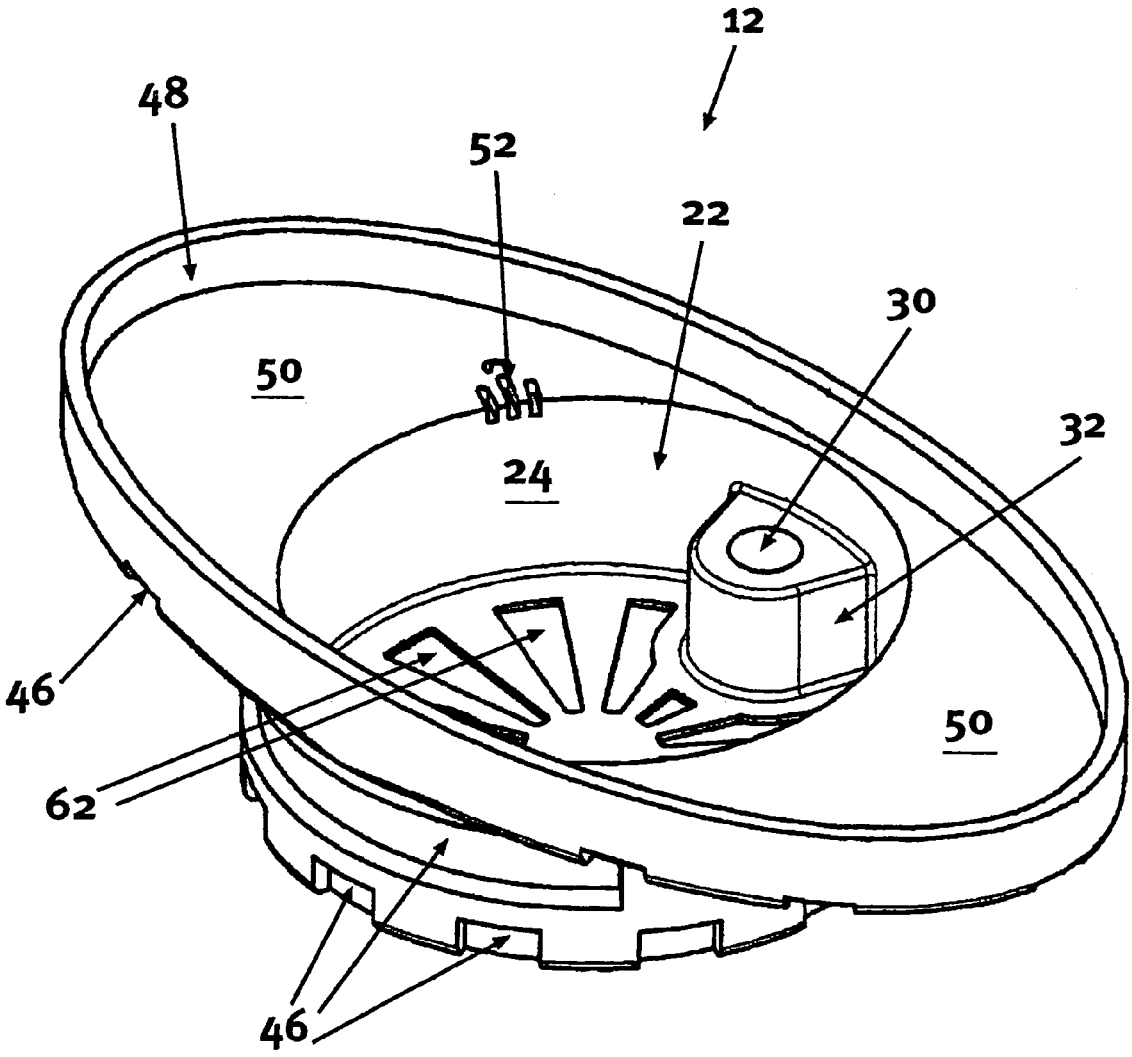
FIG. 6 shows a three-dimensional top view of a holder of the apparatus of FIG. 3.

Referring to FIG. 6 of the drawings, recesses 62 are defined in a bottom of the recess 22, into which particulate solids, such as sand, salt, etc., which may become trapped between the body 20 and the holder 12, may be accommodated. This prevents the particulate solids from abrading surfaces of the holder 12 and the body 10, when moved relative to each other.

The invention illustrated holds the advantages of allowing the longitudinal position, toe-in and splay of a fin 18 to be adjusted. It further allows fluid-dynamic properties of the surfboard 14 to be altered by allowing the fin to be removed from the surfboard 14 when desired, it causes little flow resistance when the surfboard is used, and allows a user to monitor adjustments made to the fin.

The invention claimed is:

1. Apparatus for attaching a fin to the underside of a small watercraft, said apparatus including:

a holder defining a recess, the holder being attachable to the watercraft, with the recess extending inwardly from the underside of the watercraft;

at least two bodies which are each receivable within the recess defined in the holder, and each of which defines an elongate fin slot orientated at a different angular orientation; and a fin including an attachment formation which is receivable within each fin slot;

characterised in that each body is receivable in the recess in a plurality of angular orientations about an axis generally perpendicular with the underside of the watercraft, that the whole attachment formation of the fin is longitudinally displaceable within each fin slot, and that each body is substitutable with another body defining a fin slot orientated at a different angular orientation relative to the plane of the underside of the watercraft, so that the fin, including the attachment formation, is receivable with the plane of the fin orientated with a different angle being defined between the plane of the fin and the plane of the underside of the watercraft.

2. Apparatus as claimed in claim 1, characterised in that the body includes fin locating means, disposed to locate the attachment formation of the fin relative to the body, when received in the fin slot.

3. Apparatus as claimed in claim 2, characterised in that the fin locating means includes at least one recess, which causes a local weakening in the structural strength of the body.

4. Apparatus as claimed in claim 1, characterised in that the body is arcuately displaceable about the axis, when received within the recess defined in the holder, to adjust the toe-in of the fin, and wherein the apparatus include body locating means, accessible from the underside of the watercraft, for locating the body relative to the holder.

5. Apparatus as claimed in claim 4, characterised in that the body locating means is displaceable between:

a free condition in which the body can be removed from the recess;

an adjustment condition in which the body is held captive within the recess, but can move arcuately about the axis, relative to the holder, through a limited angle; and a locating condition in which the body is fixedly located relative to the holder.

6. Apparatus as claimed in claim 1, characterised in that said holder includes at least two receiving formations, each spaced from a longitudinal axis of the recess, and each being disposed to receive at least one fastener, for releasably attaching the body within the recess.

7. Apparatus as claimed in claim 6, characterised in that a face is defined on the holder, which extends generally perpendicular to the axis of the recess, and which has an elongate outline.

8. Apparatus as claimed in claim 6, characterised in that the holder is attached to the underside of a watercraft, with the recess extending inwardly from the underside of the watercraft, with the longitudinal axis of the recess extending generally perpendicular to the underside of the watercraft, and with the face of the body generally flush with the underside of the watercraft.

9. A method of attaching a fin to an underside of a small watercraft, said method comprising the steps of:

providing a holder on the underside of the watercraft, said holder defining a recess extending inwardly from the underside;

selecting a body from at least two bodies, each defining an elongate fin slot orientated at a different angular orientation;

receiving the selected body in the recess;

fixedly locating the selected body within the recess by way of body locating means;

receiving an attachment formation of a fin within the fin slot; and fixedly locating the attachment formation within the fin slot;

characterised by arcuately displacing the selected body about an axis generally perpendicular to the underside prior to fixedly locating the body within the recess, and longitudinally displacing the whole attachment formation within the fin slot prior to fixedly locating the attachment formation within the fin slot, and further characterized in that the body is selected in which the fin slot is oriented at a predetermined angle relative to the body, and that the body is substitutable with another body in which the fin slot is oriented at a different angle relative to the plane of the underside of the watercraft, so that the fin, including the attachment formation, is receivable with the plane of the fin orientated with a different angle being defined between the plane of the fin and the plane of the underside of the watercraft.

* * * * *